US007602932B2

(12) United States Patent
Kobayashi

(10) Patent No.: US 7,602,932 B2
(45) Date of Patent: Oct. 13, 2009

(54) MICROPHONE ATTACHMENT DEVICE

(75) Inventor: Tsukasa Kobayashi, Tokyo (JP)

(73) Assignee: SMK Corporation, Tokyo (JP)

( * ) Notice: Subject to any disclaimer, the term of this patent is extended or adjusted under 35 U.S.C. 154(b) by 809 days.

(21) Appl. No.: 11/251,502

(22) Filed: Oct. 14, 2005

(65) Prior Publication Data

US 2006/0093177 A1 May 4, 2006

(30) Foreign Application Priority Data

Oct. 18, 2004 (JP) ..... 2004-302959

(51) Int. Cl.
*H04R 9/08* (2006.01)

(52) U.S. Cl. ..... 381/361; 381/355; 381/365; 381/366

(58) Field of Classification Search ..... 381/355, 381/361, 365, 366; 439/500
See application file for complete search history.

(56) References Cited

U.S. PATENT DOCUMENTS 5,830,007 A * 11/1998 Fry et al. ..... 439/500
6,220,892 B1 * 4/2001 Bishop ..... 439/500
6,319,054 B1 * 11/2001 Rippington ..... 439/500
6,773,300 B1 * 8/2004 Sudo et al. ..... 439/500
6,856,689 B2 * 2/2005 Sudo et al. ..... 381/355
7,062,053 B2 * 6/2006 Hohjyo ..... 381/174
7,344,405 B2 * 3/2008 Izuchi et al. ..... 439/500

OTHER PUBLICATIONS

Patent Abstracts of Japan for JP2004-302959 published on Oct. 28, 2004.
Patent Abstracts of Japan for JP2002-094530 published on Mar. 29, 2002.
Patent Abstracts of Japan for JP2003-037884 published on Feb. 7, 2003.

* cited by examiner

*Primary Examiner*—Curtis Kuntz
*Assistant Examiner*—Ryan C Robinson
(74) *Attorney, Agent, or Firm*—Darby & Darby P.C.

(57) ABSTRACT

Presented is device that attaches a microphone to a circuit substrate and includes a main holder unit holding a microphone and a main socket unit holding the main holder unit. Mounted in the main holder unit are inner contact pieces coming into contact with output terminals of the microphone when it is being held outer contact pieces coming into contact with inner contact pieces of first or second intermediate terminal members, and first and second terminal members formed from base sections connected at their bottom ends in a V-shape. On the main socket unit is disposed inner contact pieces, bends, bent from the upper ends thereof, and first and second intermediate terminal members formed as an inverted V-shape member from outer contact pieces formed at the lower ends thereof.

14 Claims, 9 Drawing Sheets

MICROPHONE ATTACHMENT DEVICE

INCORPORATION BY REFERENCE

The present application claims priority under 35 U.S.C. §119 to Japanese Patent Application No. 2004-302959, filed Oct. 18, 2004, in the Japanese language. The content of this application is hereby incorporated by reference in its entirety.

FIELD OF THE INVENTION

The present invention relates to a microphone attachment device for reliably connecting and supporting a compact microphone on a circuit substrate and more particularly compact microphones such as electret condenser microphones installed in a portable telephone or digital camera with video recording functions or various other types of wireless devices.

BACKGROUND OF THE INVENTION

Japanese Patent Publication No. 2004-20787 discloses a microphone device equipped with a microphone formed with a roughly cylindrical outer perimeter surface shape and a rubber holder surrounding the microphone in a cylindrical shape and supporting it. In this microphone, a main microphone unit is held in a roughly cylindrical metal case. The case itself serves as a ground terminal, and a positive terminal is disposed on the bottom end surface of the main microphone unit. The holder is equipped with a bottom wall that extends from the bottom end of the holder to the bottom end surface of the microphone. At least a section of the outer perimeter edge of the bottom wall is formed from a conductive rubber and serves as a first conductive section that is continuous with the ground terminal. A predetermined position away from, and inward of, the first conductive section is formed from conductive rubber and serves as a second conductive section continuous with the positive terminal.

The microphone is aligned and secured in a case of the device it is to be attached to, e.g., a portable telephone, and the bottom surface can be abutted to an external substrate. This will result in the microphone's case, which is the ground terminal, being electrically connected to a ground terminal formed on the external substrate by way of the first conductive section formed on the outer perimeter edge of the bottom wall of the holder, and the positive terminal of the microphone being electrically connected to a positive-side terminal formed on the external substrate by way of the second conductive section.

Thus, the positive terminal of the microphone is connected to corresponding terminals on the external substrate. However, adequate contact force and contact stroke cannot be provided between the plus terminal and the like of the microphone and the conductor sections of the holder. Furthermore, when there is electrical contact with the external substrate, positional relationships are defined, making it difficult to handle different types of microphone arrangements.

Japanese Patent Publication No. 2002-094530 discloses a microphone mounted on a boss in a mobile communication terminal. On one surface of a printed circuit substrate, a circular ring-shaped first contact and a second contact at the center thereof serve as a conductor section. On one surface of the microphone, a circular ring-shaped third contact and a fourth contact at the center thereof serve as a conductor section.

The microphone is inserted into a holder formed from a rubber material in a cylindrical shape and is then mounted on the boss disposed on the lower section surface of the mobile communication terminal case. The lower section surface of the holder is formed with a circular opening that allows the user's voice to be sent to the inserted microphone. On the upper surface thereof, a circular ring-shaped fifth contact and a sixth contact at the center thereof serve as a connector formed in a co-planar manner, thus allowing an electrical connection to be formed between the printed circuit substrate and the microphone.

A cushion is disposed around the fifth and sixth contact so that when the rear case is sealed, shock absorption is provided and the connection between the first and second contacts and the fifth and sixth contacts are guided.

This microphone connection structure is essentially the same as the microphone device from JP '807. The structure can be used in the same manner, provides the same advantages, and solves the same problems.

Japanese Patent Publication No. 2002-152874 discloses an electro-acoustic converter equipped with a microphone, a holder with a cover member that is mounted on the microphone, and a connector that electrically connects the microphone to the external substrate.

The connector is formed from a torsion coil spring that is conductive, and includes an inner end side that abuts a conductor section of the microphone, and an outer end side that abuts a conductor of an external substrate, which corresponds to the conductor of the microphone. The connector includes a shaft-shaped support member that supports the torsion coil spring so that the inner end side abuts the conductor section of the microphone.

This electro-acoustic converter has a conductor on an external substrate that abuts the outer end side of the torsion coil spring forming the connector. However, attaching the torsion coil spring to the shaft-shaped support member is not easy. A cut-out needs to be formed on the shaft-shaped support member, and the coil section has to be fitted to the outside of the shaft-shaped support member using this cut-out. This is a narrow structure and forming a cut-out large enough to allow easy fitting of the coil is difficult. Also, by forming this type of cut-out, the shaft-shaped support member will be supported in a T-shaped arrangement, or, if by the holder, in a cantilevered support. This makes it questionable whether adequate strength can be provided.

Japanese Patent Publication No. 2003-037884 discloses a microphone that includes a support member which supports a microphone on a predetermined support surface. The microphone is formed as a cylindrical case with a sound opening on a ceiling, signal output electrodes on a base and a terminal member, secured to the support member, that transmits a signal from the signal output electrodes to an external circuit. An opening formed on the support surface of the support member is sealed by the terminal member. With this microphone holder, the terminal member is disposed integrally, and the opening created when shaping the support member is sealed by the terminal member. As a result, expansion of the base side of the microphone holder resulting from using sealing means is avoided, thus providing a more compact design.

OBJECT AND SUMMARY OF THE INVENTION

By way of introduction the present invention provides a microphone attachment device that is compact, provides stable features, and is formed from a microphone holder and a socket into which the holder is mounted. The microphone holder has a bull's eye shaped output terminal that holds and supports the microphone in a simple and reliable manner. Terminal members are provided which form reliable connections to a pair of output terminals without the possibility of short circuits between them. The socket can be mounted reliably and smoothly in the microphone holder. The terminal members can connect reliably to the corresponding terminals on a circuit substrate when the socket is attached to the circuit substrate.

In one aspect of the invention a microphone attachment device includes a microphone holder holding a microphone and a socket holding the microphone holder, and a microphone attachment device. The microphone holder includes a main holder unit equipped with a microphone holding section and a pair of terminal attachment slits. A pair of elastic terminal members are inserted into the terminal attachment slits, the terminal member includes an inner contact piece coming into contact with a center terminal of an output terminal of the microphone, an outer contact piece exposed to the socket side, and a base connecting the outer contact piece, the terminal member including an inner contact piece coming into contact with an outer perimeter terminal of the output terminal of the microphone. An outer contact piece is exposed to the socket side, and a base connects the inner contact piece and the outer contact piece. The terminal members are formed with a V-shaped bend near the bases, the socket includes a main socket unit equipped with a holder holding section into which the microphone holder is inserted, a pair of elastic intermediate terminal members formed in an inverted V shape include, on a first end, inner contact pieces coming into contact with the outer contact pieces of the pair of terminal members of the microphone holder held in the holder holding section of the main socket unit, and, on a second end, outer contact pieces.

In another aspect of the invention, the microphone holding section opens to the front surface of the main holder unit.

In a further aspect of invention, the pair of terminal attachment slits is formed so that the pair of terminal members can be inserted at a rear section of the main holder unit from both sides; and the pair of terminal members are formed to allow insertion into the pair of terminal attachment slits from their respective sides.

In a further aspect of the invention, wherein each of the pair of terminal attachment slits is formed from outer-end engagement slits disposed at an intermediate position on a back surface of the main holder unit to allow insertion of corresponding back outer-ends of the outer contact pieces of the terminal members; contact surfaces disposed on a lower section of a back surface of the main holder unit 3 to position the outer contact pieces of the terminal members; and lower through-slits disposed at a lower section of the main holder unit.

In another aspect of the invention, wherein the output terminal of the microphone M held in the microphone holding section of the main holder unit is formed in a bull's eye arrangement.

In yet another aspect of the invention, wherein the inner contact piece are formed so that, when facing a back surface of the main holder unit of the microphone holder, a connection is formed with the outer contact pieces of the pair of terminal members of the microphone holder held in the holder holding section of the main socket unit; downward bends are formed at upper ends of the inner contact pieces; and outer contact pieces connect with lower ends of the bends.

In yet a further aspect of the invention, wherein with the pair of terminal members disposed in terminal attachment slits of the main holder unit, the base 2*a*4 of the terminal member 2*a* extends laterally away from the inner contact piece 2*b*3 of the terminal member 2*b*, the base 2*b*4 of the terminal member 2*b* extends laterally away from the inner contact piece 2*a*3 of the terminal member 2*a*, the outer contact piece 2*a*2 is projected upward from a position away from the inner contact piece 2*b*3 of the terminal member 2*b*, and the outer contact piece 2*b*2 is projected upward from a position away from the inner contact piece 2*a*3 of the terminal member 2*a*.

In another aspect of the invention, wherein terminal holding sections opening to the holder holding section are formed at positions on the socket facing the outer contact pieces of the pair of terminal members of the microphone holder mounted in the holder holding section; and the intermediate terminal members are disposed in the terminal holding sections.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1A:
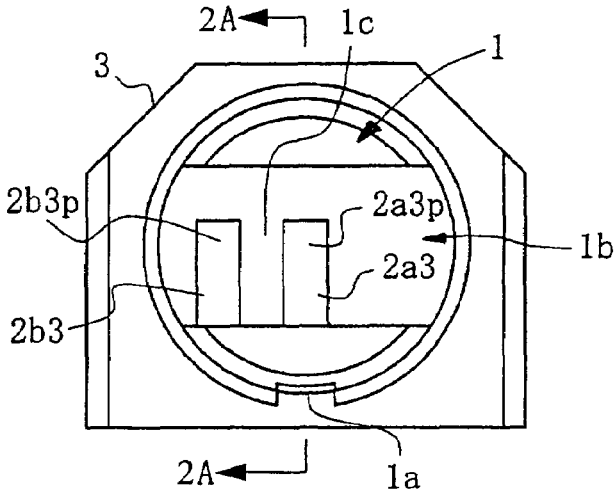
FIG. 1(*a*) is a front-view drawing of a microphone holder, FIG. 1(*b*) is a right side view drawing of a microphone holder, FIG. 1(*c*) is a plan drawing of a microphone holder, FIG. 1(*d*) is a rear-view drawing of a microphone holder, FIG. 1(*e*) is a bottom-view drawing of a microphone holder.
Figure 1B:
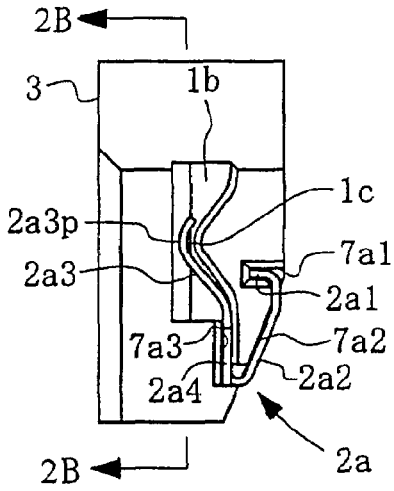
Figure 1C:
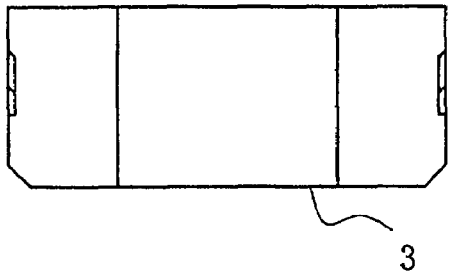
Figure 1D:
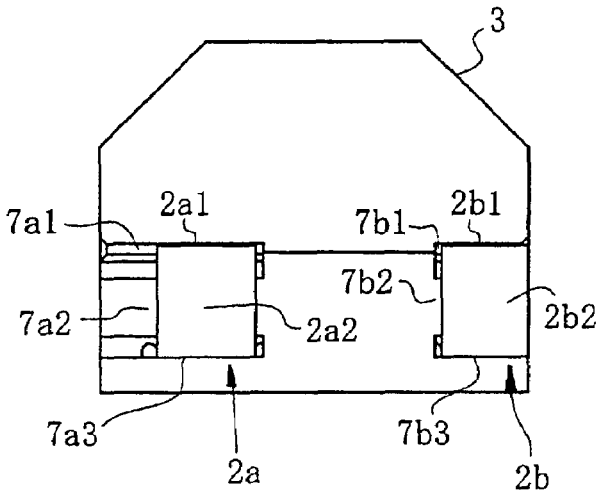
Figure 1E:
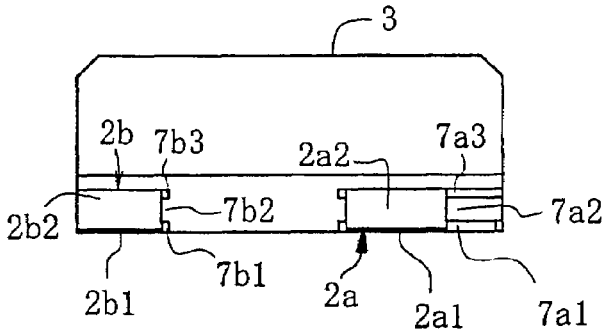

An example of this type of microphone attachment device is a structure formed only from a microphone holder equipped with a housing space for housing the microphone. The microphone holder itself is formed solely from a main holder unit and essentially has as its objective to hold the microphone and engage and position it to engaging means or the like of the circuit substrate to which it is being attached. The contact member that electrically connects the pair of output terminals of the microphones to the corresponding terminals of the circuit substrate must be prepared separately.

Another example of this type of microphone attachment device is a microphone holder including: a main holder unit equipped with a holding space for holding a microphone; and contact members for electrically connecting a pair of output terminals of the microphone held in the main holder unit with corresponding terminals of a circuit substrate. In this microphone attachment device, the contact members are formed integrally with the main holder unit. The object of this structure is to electrically connect a pair of output terminals of the microphone to the circuit substrate by engaging the main holder unit holding the microphone to predetermined engaging means or the like of the circuit board, and also connecting each of the contact members to the corresponding terminals of the circuit substrate.

Yet another example of this type of microphone attachment device is formed from a microphone holder and a socket including a mounting space for mounting the microphone holder. The present invention is a microphone attachment device of this type. This type of microphone holder device includes: a main holder unit equipped with a holding space for holding a microphone; and a contact member for electrically connecting a pair of output terminals of the microphone to corresponding terminal members of a socket described below. The contact member is formed on the main holder unit. The socket is equipped with two terminal members that form an electrical connection to terminals on the circuit substrate that correspond to the contact members when the microphone holder is mounted in the mounting space.

In this type of microphone attachment device, the socket is secured ahead of time to a predetermined position on the circuit substrate, with the terminal members being in contact with the predetermined terminals of the circuit substrate. The microphone holder holding the microphone is then mounted in the mounting space of the socket, thus aligning the microphone and electrically connecting the pair of output terminals of the microphone to the corresponding terminals of the circuit substrate by way of the contact members and the terminal members.

With the microphone attachment device the output audio signal of the microphone can be reliably transmitted to the circuit substrate.

Since the terminal members and the intermediate terminal members are formed roughly in a V shape or an inverted V shape and are formed with members having elasticity, the contact between the inner contact pieces of the terminal members and the center and outer perimeter terminals of the microphone as well as the contact between the outer contact pieces of the terminal members and the inner contact pieces of the intermediate terminal members can easily provide the necessary load in a small space, thus providing a good electrical connection.

By using a member that has elasticity for the main holder unit, the elasticity can be used to strengthen the contact between the output terminal of the microphone and the inner contact piece of the terminal member as well as the contact between the outer contact piece of the terminal member and the inner contact piece of the intermediate terminal member.

The outer contact pieces of the intermediate terminal members of the socket can be formed freely in terms of shape and orientation. Good connections can be provided to the associated terminals of the circuit substrate simply by attaching the socket to the circuit substrate.

Also, since the pair of terminal members is inserted in the terminal attachment slits of the main holder unit, the attachment operation is very easy and reliable.

The microphone can be easily inserted in the microphone holding section of the main holder unit from the front, thus allowing smooth assembly.

Preferably, the terminal attachment slits are formed at the sides at the back of the main holder unit, and the V-shaped terminal members can be inserted from the sides, while the terminal members themselves are formed to be suited for this. As a result, the assembly of the latter to the former is made extremely easy.

Alternatively, the terminal attachment slits are formed at the sides at the back of the main holder unit as described above, and the different elements of the V-shaped terminal members can be inserted from the sides to corresponding positions. As a result, the assembly operation is made extremely easy, the structure of the back of the main holder unit can be made compact, and the overall microphone attachment device can be made compact.

When the microphone is mounted in the microphone holding section of the main holder unit, the microphone can be inserted at any orientation angle. Since the output terminal on the back forms a bull's eye arrangement, the inner contact pieces of the terminal members can accurately and reliably connect with the corresponding center terminal and the outer perimeter terminal. This prevents short-circuits.

When the microphone is mounted in the microphone holder and the main socket unit is mounted in the holder holding section, an elastic contact forms naturally between the outer contact pieces of the pair of terminal members exposed at the back of the main holder unit and the inner contact pieces of the pair of intermediate terminal members disposed in the main socket unit, providing a good electrical connection. Also, by joining the inner contact piece and the outer contact piece by way of the bend, the elasticity of the material can be used effectively.

When the terminal members attached to predetermined positions on the main holder unit, the outer contact pieces projected outward from the bases thereof are positioned with an adequate space between them, thus preventing short circuits. Also, the outer contact pieces are formed with adequate widths so that the corresponding inner contact pieces of the intermediate terminal members can form reliable connections with the outer contact pieces. As a result, the shape of the inner contact pieces of the intermediate terminal members can be defined relatively freely according to the application without special restrictions.

The terminal holding section opens to the holder holding section and the intermediate terminal members are disposed in the terminal holding sections. As a result, the structure is simplified, and assembly is made more efficient. Also, the structure makes it possible to take advantage of the elasticity of the material used in the intermediate terminal members.

The microphone attachment device of one configuration includes a microphone holder holding a microphone, and a socket holding the microphone holder. The microphone holder includes: a main holder unit equipped with a microphone holding section open to the front surface and a pair of terminal attachment slits at the back into which terminal members are inserted from both sides; and a pair of terminal members inserted and secured in the pair of terminal attachment slits. The socket includes: a main socket unit equipped with a holder holding section into which the microphone holder is slid; and a pair of intermediate terminal members disposed on the main socket unit in alignment and correspondence with the pair of terminal members on the microphone holder held in the holder holding section.

The microphone handled by one implementation of the present invention is a short, cylindrical or disc-shaped compact microphone, a representative example being an electrets condenser microphone, with an output terminal disposed on the rear surface using a bull's eye placement. Bull's eye placement refers to a terminal arrangement formed from a circular center terminal and, surrounding this in a ring-shaped manner, a ring-shaped outer perimeter terminal. In many cases, the outer perimeter terminal is the ground terminal but this is not necessarily the case.

The microphone holding section is a space for holding the microphone that opens to the front surface of the main holder unit. The space is formed as a short cylindrical or disc shape with an inner diameter that is slightly larger than the outer diameter of the microphone. In this microphone holding space, the front opening serves as the mounting opening for the microphone. It would be preferable for a suitable stopper to be disposed on the front edge of this opening so that the mounted microphone is prevented from slipping out while not obstructing the mounting of the microphone.

On the central section of the rear surface (bottom surface) of the microphone holding section, a space for a contact piece having a suitable width can be cut out, with inner contact pieces of the terminal members being inserted into this contact-piece space. This contact-piece space should have a shape and dimensions that allow the bull's eye output terminal on the rear of the microphone to face this space. On the rear surface of the contact-piece space, there can be formed a lateral mound-shaped projection along a lateral row that includes a position that faces the center terminal of the output terminal, with this position being projected furthest to the front. Immediately in front of this can be positioned the contacts of the inner contact pieces of the pair of terminal members. The contacts of the inner contact pieces are positioned so that they project into the microphone holding section. The microphone is mounted in the microphone holding section. When the contact of the inner contact piece is pushed back by the output terminal, the rear side of the contact abuts the apex of the projection, which provides support from the back.

The pair of terminal attachment slits includes: an outer end engagement slit for inserting and supporting the rear outer ends of the terminal members; a contact surface to position the outer contact piece of the terminal member in a contact state; and a lower through-slit for inserting and supporting a lower section and a base section of the inner contact piece of the terminal member. The terminal attachment slits are for inserting the terminal members from the side of the main holder unit, so the slits are also opened to the side. The contact surface should be formed so that when the main holder unit is vertical it is sloped downward thus providing a good contact between the outer contact piece of the terminal member and the inner contact piece of an intermediate terminal member, described later.

As described above, the terminal members are a pair of elastic members that are inserted from the sides through the terminal attachment slits. A first terminal member electrically connects the center terminal of the output terminals in a bull's eye arrangement on the microphone with the corresponding terminal on the circuit substrate by way of itself and the intermediate terminal member. A second terminal member electrically connects the outer perimeter terminal of the output terminals in a bull's eye arrangement on the microphone with the corresponding terminal on the circuit substrate by way of itself and the intermediate terminal member.

The first terminal member is formed from: an inner contact piece; an outer contact piece equipped with a rear outer terminal at the outer end thereof; and a base connecting these elements. There is a roughly V-shaped bend near the base. In the inner contact piece, the contact at the free end in particular comes into contact with the center terminal of the microphone. As described above, the lower section is inserted into the lower through-slit out of the terminal attachment slits, and the contact is inserted into the microphone holding section from the rear side. The outer contact piece is formed projecting up from the base, with the rear outer end, i.e., the outer end, is bent toward the inner contact piece. The outer contact piece is formed projecting up from the base and is projected out from the main holder body to abut the contact surface of the terminal attachment slit, the rear outer end of the uppermost section thereof being inserted to the outer end engagement slit and secured.

The outer contact piece should be formed wide to provide a reliable contact between the intermediate terminal member and the inner contact piece. In order to do this while preventing short-circuits between the outer contact pieces when the pair of terminal members are disposed at predetermined positions on the main holder unit, the base should be extended laterally as much as possible away from the inner contact pieces, and the outer contact pieces should be projected upward from positions as far away as possible from the base.

As in the first terminal member, the second terminal member is formed from: an inner contact piece; an outer contact piece equipped with a rear outer terminal at the outer end thereof; and a base connecting these elements; and there is a roughly V-shaped bend near the base. The inner contact piece, as described above, is formed so that the contact at its free end comes into contact with the outer perimeter terminal of the microphone. The lower section thereof is inserted into the lower through-slit of the terminal attachment slit, and the contact is projected into the microphone holding section from the rear surface. The only difference from the first terminal member is that the contact of the inner contact piece comes into contact with the outer perimeter terminal of the microphone. This leads to other differences such as the need to shorten the length slightly when the base is extended laterally, the reversal of the direction of extension, and the like. However, other aspects of the structure are almost identical.

As described above, this holder holding section is a holding space that allows the microphone holder to be slid in. The space is shaped to allow the microphone to be mounted so that the bases of the terminal members are on the bottom.

As described above, the intermediate terminal members are a pair of elastic members disposed on the main socket unit. A first intermediate terminal member electrically connects the center terminal of the output terminals in the bull's eye arrangement on the microphone with the corresponding terminal on the circuit substrate. A second intermediate terminal member electrically connects the outer perimeter terminal of the output terminals in the bull's eye arrangement on the microphone with the corresponding terminal on the circuit substrate.

The pair of intermediate terminals members are associated with the outer contact pieces with the terminal members on the microphone holder held in the holder holding section and define positional relationships. The first terminal member connects to the center terminal of the bull's eye output terminals on the microphone, and the second terminal member connects to the outer perimeter terminal. When the lateral length of the base is adjusted as described above, the outer contact piece of the former terminal member will be positioned more toward the center, while the outer contact piece of the latter will be positioned more away from the center. The internal contact pieces of the intermediate terminal members will be disposed at their respective positions.

As described above, each intermediate terminal member is formed as an inverted V-shaped member formed from an inner contact piece that comes into contact with the outer contact piece of a terminal member, a bend formed by bending the upper end of thereof downward; and an outer contact piece formed at the lower end.

Terminal holding sections are formed in the socket, and the pair of intermediate terminal members are disposed therein. The inner contact pieces thereof form connections with the outer contact pieces. Thus, the terminal holding sections should be formed at positions facing the outer contact pieces of the pair of terminal members of the microphone holder when it is mounted in the holder holding section. The terminal holding sections should, of course, be open toward the holder holding section. The inner contact pieces should project from the openings to the holder holding section.

As described above, the terminal member of the microphone holder is roughly V-shaped, and the contact surfaces of the outer contact pieces are sloped downward when the microphone holder is mounted in the holder housing section. Also, since the intermediate terminal members are held in roughly an inverted V shape in the terminal holding sections, the contact surfaces of the inner contact pieces are sloped upward. Thus, when the microphone holder is slid into the holder holding section, the outer contact pieces of the terminal members slide against and come into contact with the inner contact pieces of the intermediate terminal members. When the microphone holder is completely mounted in the holder holding section, reliable connections are provided.

The securing of the intermediate terminal members to the terminal holding section can be performed using any means. For example, an engagement groove extending from an intermediate position on the innermost surface of the terminal holding section, i.e., the surface opposite from the holder holding section, to the lowermost position while expanding to laterally. Extensions that can enter the engagement grooves are formed on both sides of the bends of the intermediate terminal members. When the latter is inserted into the former from below and the extensions are inserted into the engagement grooves, the shoulders of the extensions abut the upper ends of the engagement grooves, preventing the intermediate terminal members from moving up any further.

Engagement offsets are disposed at intermediate positions on both sides of the extensions. The bottom section of the engagement offset extends outward at a right angle from the side of the extension, and the upper section thereof extends diagonally from the outermost extended end to the side of the extension. After the intermediate terminal members are mounted in the terminal holding sections in this manner, when an external force is directed in a direction that would pull out the terminal members, the engagement offsets engage with the engagement grooves, thus preventing the structure from slipping out.

Thus, with the microphone attachment device in accordance with one configuration of the present invention, the attachment of the microphone can be performed by mounting the microphone in the microphone holding section of the microphone holder and then mounting the microphone holder in the socket holder holding section secured ahead of time to a circuit substrate.

The mounting of the microphone to the microphone holding section is performed from the opening on the front surface. The microphone is mounted from the back. The output terminals for a bull's eye arrangement, and reliable connections between the terminal members and the inner contact pieces are made no matter what the circumferential orientation is during mounting. Thus, problems and short-circuits are avoided. By forming a stopper as described above, the microphone mounted in the microphone holding section is reliably kept in.

When the bases of the terminal members are extended laterally and the outer contact pieces are formed wide while providing adequate space between them, as described above, short-circuits are avoided and a reliable connection can be formed with the corresponding inner contact pieces of the intermediate terminal members. As a result, the shape of the inner contact pieces of the intermediate terminal members can be defined relatively freely according to the circumstances.

The terminal members and the intermediate terminal members are all formed roughly in V shapes or inverted V shapes, and are formed from members having elasticity. As a result, the connections between the inner contact pieces of the terminal members and the center terminal and the outer perimeter terminal of the microphone and the connections between the outer contact pieces of the terminal members and the inner contact pieces of the intermediate terminal members can easily provide the necessary load in a small space, thus offering good electrical connections. Also, when a member having elasticity is used in the main holder unit, the elasticity can be used to strengthen the connections between the inner contact pieces of the terminal members and the microphone output terminals and the connections between the outer contact pieces of the terminal members and the inner contact pieces of the intermediate terminal members of the socket.

Thus, the output audio signal from the microphone can be reliably transmitted to the circuit substrate. The shape and the orientation of the outer contacts formed at the bottom ends of the bends of the intermediate terminal members of the socket can be defined freely, and a good connection with the corresponding terminals can be provided simply by attaching the socket to the circuit substrate.

Preferably, the terminal members of the microphone holder can be slid in from the side through the terminal attachment slits formed at the back and sides of the main holder unit. As a result, the attachment operation is simple, the structure of the back of the main holder unit can be made compact, and the microphone attachment device can be made compact overall. Furthermore, forming the terminal holding section that opens up the intermediate terminal members to the holder holding section side, the structure is simplified and assembly is made more efficient.

First Embodiment

A microphone attachment device according to this embodiment includes, essentially: a microphone holder holding a microphone M; and a socket holding the microphone holder.

Figure 2A:
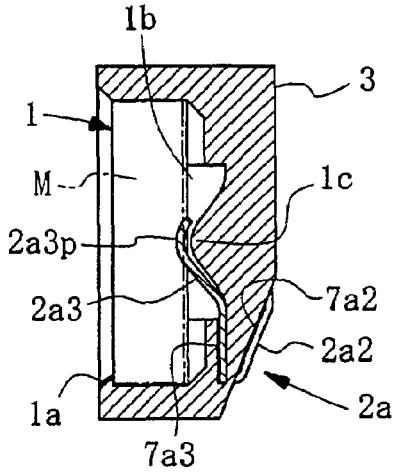
FIG. 2(*a*) is a cross-section drawing along the 2A-2A line of FIG. 1(*a*), FIG. 2(*b*) is a cross-section drawing along the 2B-2B line of FIG. 1(*b*)
Figure 2B:
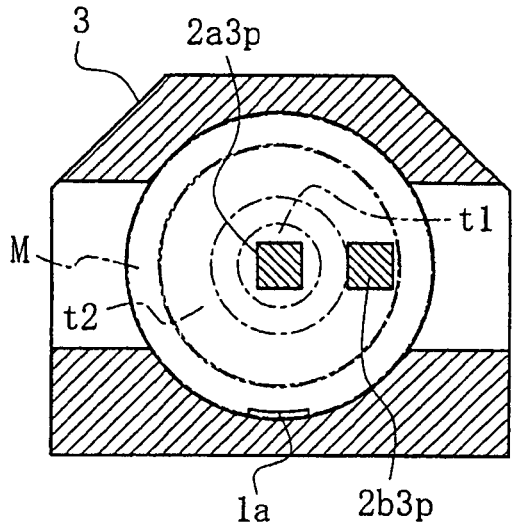
Figure 8A:
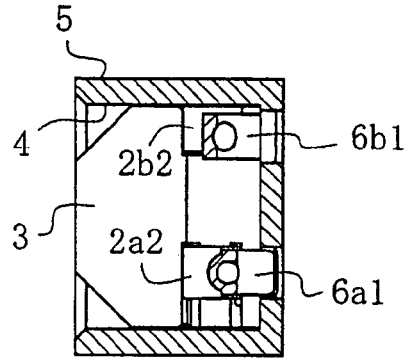
FIG. 8(*a*) is a cross-section drawing along the 8A-8A line of FIG. 7(*a*), FIG. 8(*b*) is a cross-section drawing along the 8B-8B line of FIG. 7(*a*), FIG. 8(*c*) is a cross-section along the 8C-8C line of FIG. 7(*a*)
Figure 8B:
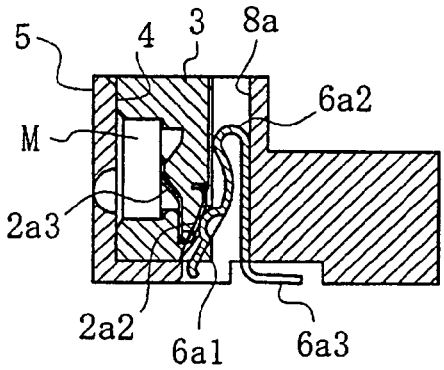
Figure 8C:
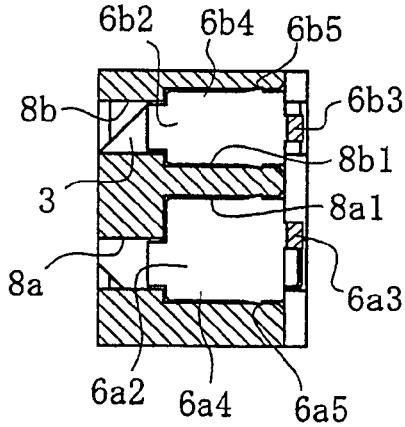

As shown in FIG. 1(*a*) through FIG. 1(*e*), FIG. 2(*a*), FIG. 2(*b*), FIG. 8(*a*), and FIG. 8 (*b*), the microphone holder is equipped with a microphone holding section 1 that opens to the front surface, a main holder unit 3 formed with a first terminal attachment slit and a second terminal attachment slit into which are inserted from the rear a first terminal member 2*a* or a second terminal member 2*b* respectively, and the first terminal member 2*a* and the second terminal member 2*b*, which are inserted and secured in the first terminal attachment slit and the second terminal attachment slit. As shown in FIG.

7(*a*) through FIG. 7(*d*) and FIG. 8(*a*) through FIG. 8(*c*), the socket includes a main socket unit 5 equipped with a holder holding section 4 into which the microphone holder is slid and a first intermediate terminal member 6*a* and a second intermediate terminal member 6*b*, which are used to position the first terminal member 2*a* and the second terminal member 2*b* respectively of the microphone holder held in the holder holding section 4.

Figure 3:
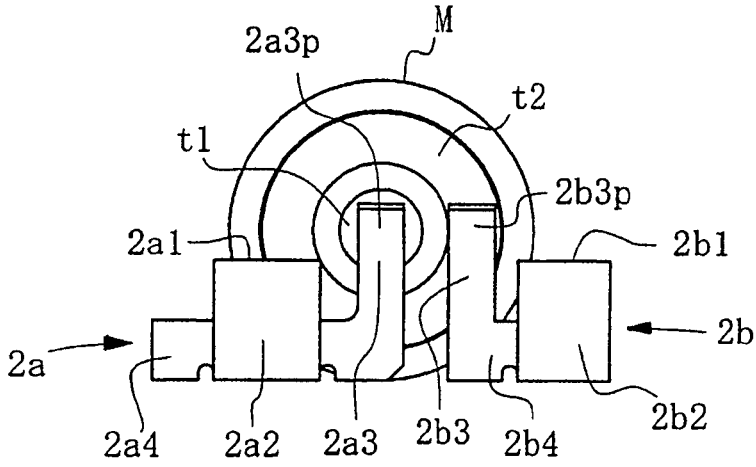
FIG. 3 is a back-view drawing illustrating a first terminal member and a second terminal member in accordance with an embodiment of the present invention.

The microphone M for which this embodiment is used is a disc-shaped electret condenser microphone, as shown in FIG. 2(*a*), FIG. 2(*b*), and FIG. 3, and is equipped with a bull's eye type output terminal on the back surface formed from a circular center terminal t1 and a ring-shaped outer perimeter terminal t2, which surrounds the center terminal t1 in a ring shape and is separated by an insulating section.

The main holder unit 3 has the structure described above. An exterior view, as shown in FIG. 1(*a*) through FIG. 1(*e*) shows that the member is a thick plate having shoulders cut at 45 deg with the front surfaces beveled. A diagonal cut is formed on the lower section of the back side. The structure is shaped from a plastic that has elasticity.

As shown in FIG. 1(*a*), FIG. 2(*a*), and FIG. 2(*b*), the microphone holding section 1 is a space for holding the microphone M and opens to the front surface of the main holder unit 3. The space is a roughly disc-shaped space having an inner diameter that slightly exceeds the outer diameter of the microphone M. The front-surface opening is used to allow the mounting of the microphone M. The edge of the opening is beveled. As shown in FIG. 1(*a*), FIG. 2(*a*), and FIG. 2(*b*), a stopper 1*a* is projected inwardly at the center of the lower section of the edge of the opening to prevent the microphone M held in the microphone holding section 1 from slipping out. The stopper 1*a* is formed with a diagonal cut at its end to form a bevel, thus allowing smooth mounting of the microphone M.

As shown in FIG. 1(*a*), FIG. 1(*b*), FIG. 2(*a*), and FIG. 2(*b*), a contact-piece space 1*b* is cut out from the rear surface (bottom surface) of the microphone holding section 1. This contact-piece space 1*b* is a lateral space cut out in a band shape that includes the central section of the diameter of the microphone holding section 1. The space has a width that slightly exceeds half the diameter of the microphone holding section 1. As shown especially in FIG. 1(*b*) and FIG. 2(*b*), the space is extended all the way to open up on both sides of the main holder unit 3.

As shown in FIG. 1(*b*) and FIG. 2(*a*), the rear surface of the contact-piece space 1*b* is formed with a lateral mound-shaped projection 1*c* that is positioned to include a position facing the center of the microphone holding section 1. The projection is formed so that it is most projected toward the front side at the position of the row.

As shown in FIG. 1(*a*) through FIG. 1(*e*) and FIG. 2(*a*) and FIG. 2 (*b*), the first terminal attachment slit and the second terminal attachment slit are formed on the rear of the main holder unit 3 to the left and the right. Both have fundamentally the same structure except that the former is longer laterally.

As shown in FIG. 1(*a*) through FIG. 1(*e*) and FIG. 2(*a*) and FIG. 2 (*b*), the first terminal attachment slit includes an outer end engagement slit 7*a*1 for insertion and support of a rear outer terminal 2*a*1 of the first terminal member 2*a*, a contact surface 7*a*2 positioning the outer contact piece 2*a*2 of the first terminal member 2*a*, so that abutting takes place, and a lower through-slit 7*a*3 for insertion and support of a base 2*a*4 and the lower section of an inner contact piece 2*a*3 of the first terminal member 2*a*.

As shown in FIG. 1(*b*), FIG. 1(*d*), and FIG. 1(*e*), the outer end engagement slit 7*a*1 is a slit formed along the upper boundary of the sloped surface formed at the lower bottom surface of the main holder unit 3. It is extended from one side toward the center across slightly more than ⅓ the lateral width of the main holder unit 3. The outer end engagement slit 7*a*1 opens up to one side. As shown in FIG. 1(*b*), FIG. 1(*d*), FIG. 1(*e*), and FIG. 2(*a*), the contact surface 7*a*2 is formed by the section of the sloped surface positioned below the outer end engagement slit 7*a*1. Also, as shown in FIG. 1(*b*), FIG. 1 (*d*), FIG. 1(*e*), and FIG. 2(*a*), the lower through-slit 7*a*3 opens up to the rear surface of the main holder unit 3 in alignment with the outer end engagement slit 7*a*1, with the same lateral length, and positioned slightly toward the front side. The slit is extended parallel to the front surface and extends to the contact piece space 1*b*. Of course, this lower through-slit 7*a*3 is also opened to one side.

The structure of the second terminal attachment slit is similar to that of the first terminal attachment slit. As shown in FIG. 1(*a*) through FIG. 1(*e*) and FIG. 2 (*a*) and FIG. 2 (*b*), the slit is formed from an outer end engagement slit 7*b*1 for inserting and supporting the rear outer terminal 2*b*1 of the second terminal member 2*b*, a contact surface 7*b*2 positioning the outer contact piece 2*b*2 of the second terminal member 2*b* so that abutting takes place, and a lower through-slit 7*b*3 for insertion and support of a base 2*b*4 and the lower section of an inner contact piece 2*b*3 of the second terminal member 2*b*.

As shown in FIG. 1(*b*), FIG. 1(*d*), and FIG. 1(*e*), the shape, the depth, and the width of the outer end engagement slit 7*b*1 are similar to that of the outer engagement slit 7*a*1 of the first terminal attachment slit, but the length is shorter and extends from the other side toward the center and spans approximately ⅕ of the lateral width of the main holder unit 3. The relationship between the contact surface 7*b*2 and the contact surface 7*a*2 of the first terminal attachment slit and the relationship between the lower through-slit 7*b*3 and the lower through-slit 7*a*3 of the first terminal attachment slit are also similar. Of course, the lower through-slit 7*b*3 of the second terminal attachment slit opens up to the opposite side of the main holder unit 3.

The first terminal member 2*a* and the second terminal member 2*b* have similar structure, but since they are formed to slide into the first terminal attachment slit and the second terminal attachment slit respectively, they differ in ways corresponding to the different dimensions of the slits.

Figure 4A:
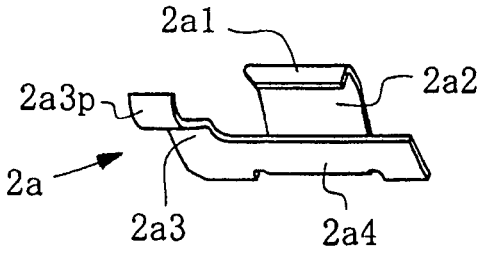
FIG. 4(*a*) is a perspective drawing of a first terminal member, FIG. 4(*b*) is a perspective drawing of a second terminal member.
Figure 4B:
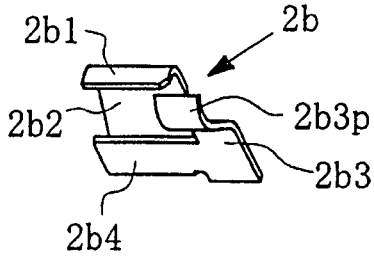
Figure 5A:
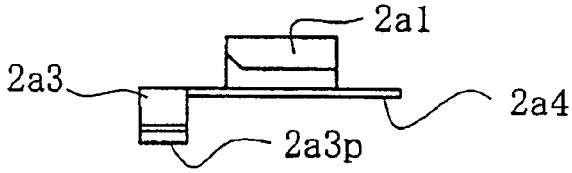
FIG. 5(*a*) is a plan drawing of a first terminal member, FIG. 5(*b*) is a left side view drawing of a first terminal member, FIG. 5(*c*) is a front-view drawing of a first terminal member, FIG. 5(*d*) is a right side view drawing of a first terminal member.
Figure 5B:
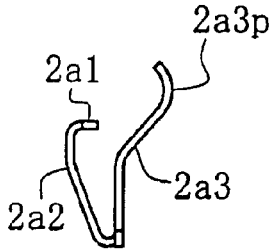
Figure 5C:
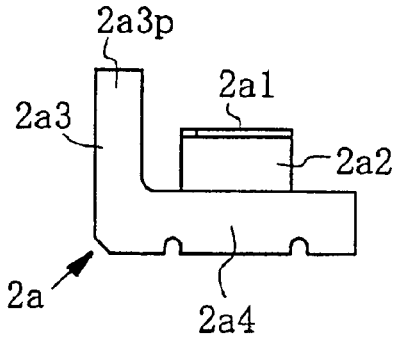
Figure 5D:
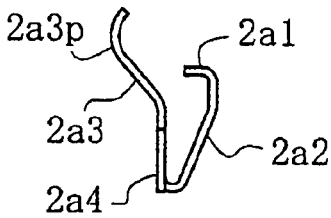
Figure 6A:
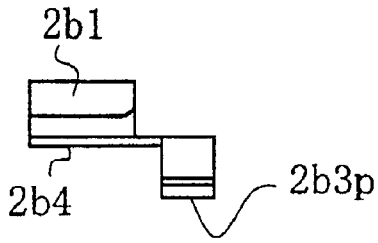
FIG. 6(*a*) is a plan drawing of a second terminal member, FIG. 6(*b*) is a left side view drawing of a second terminal member, FIG. 6(*c*) is a front-view drawing of a second terminal member, FIG. 6(*d*) is a right side view drawing of a second terminal member.
Figure 6B:
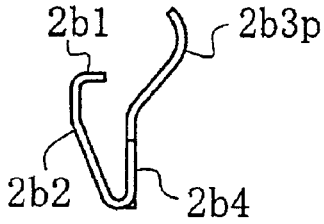
Figure 6C:
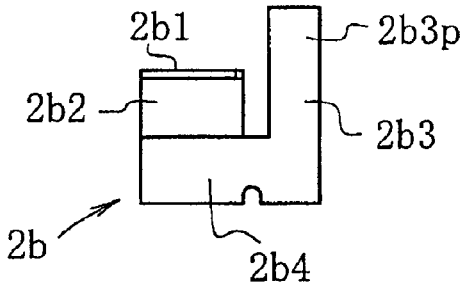
Figure 6D:
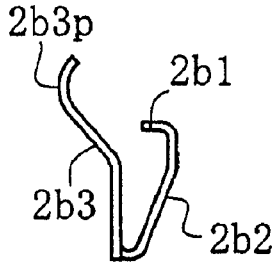
Figure 7A:
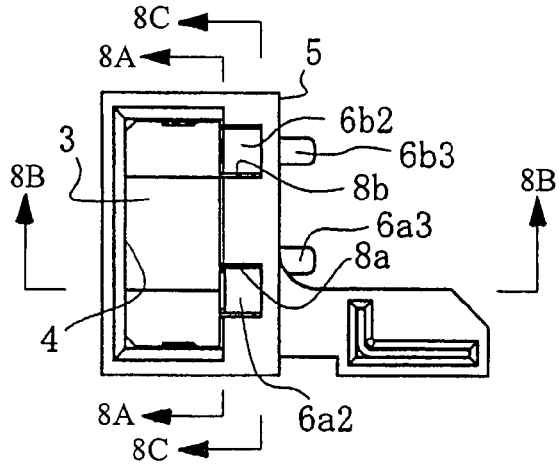
FIG. 7(*a*) is a plan drawing of a microphone attachment device, FIG. 7(*b*) is a front-view drawing of a microphone attachment device, FIG. 7(*c*) is a right side view drawing of a microphone attachment device, FIG. 7(*d*) is a bottom-view drawing of a microphone attachment device.
Figure 7B:
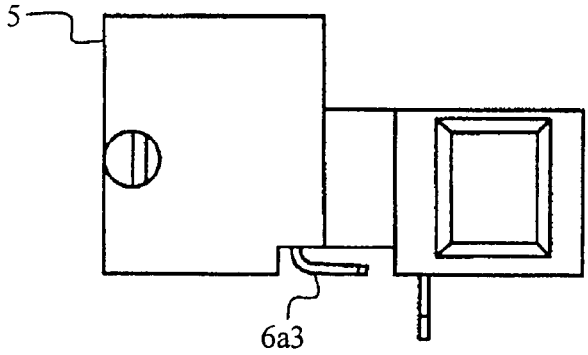
Figure 7C:
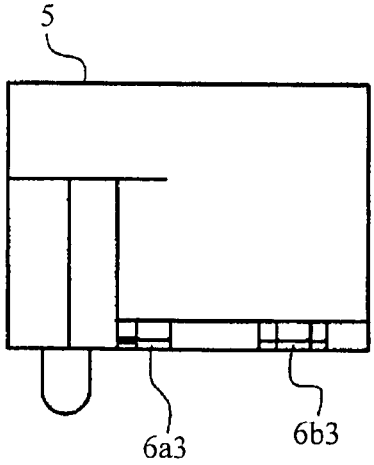
Figure 7D:
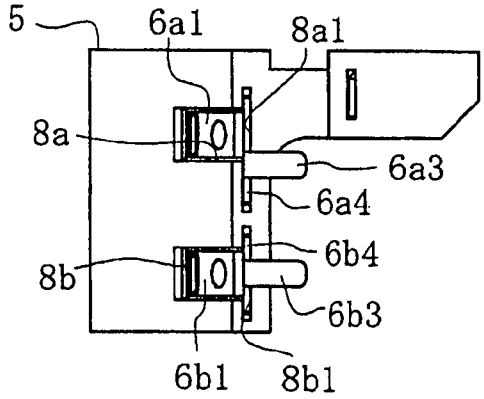

As shown in FIG. 4(*a*), FIG. 4(*b*), FIG. 5(*a*) through FIG. 5(*d*), and FIG. 6(*a*) through FIG. 6(*d*), the first terminal member 2*a* and the second terminal member 2*b* are formed from inner contact pieces 2*a*3, 2*b*3, which extend in strip shapes, and plate-shaped outer contact pieces 2*a*2, 2*b*2, which are equipped on the outer ends with the rear outer ends 2*a*1, 2*b*1. A bend is formed in the vicinity of the boundary between the base 2*a*4, 2*b*4 and the outer contact piece 2*a*2, 2*b*2 to form roughly a V shape. These are formed as elastic members and are, of course, made from a metal that is a good conductor.

As shown in FIG. 4(*a*), FIG. 4(*b*), FIG. 5(*a*) through FIG. 5(*d*), FIG. 6(*a*) through FIG. 6(*d*), and FIG. 8(*b*), inner contact pieces 2*a*3, 2*b*3 are formed with contacts 2*a*3*p*, 2*b*3*p*, which project toward the respective output terminal of the microphone M, which they are in contact with. The bases 2*a*4, 2*b*4, as shown in FIG. 1(*d*) and FIG. 3, are formed as band-shaped members extending laterally so that the inner contact pieces 2*a*3 and 2*b*3 are spaced away from each other when the first terminal member 2*a* and the second terminal member 2*b* are inserted into the first terminal attachment slit and the second terminal attachment slit respectively of the main holder unit 3. The outer contact pieces 2*a*2, 2*b*2 are formed so that they are projected upward from the bases 2*a*4, 2*b*4 at positions away from the inner contact pieces 2*a*3 and 2*b*3. On the back outer ends 2a1, 2b1 are, as shown in FIG. 4(*a*), FIG. 4(*b*), FIG. 5(*a*) through FIG. 5(*d*), and FIG. 6(*a*) through FIG. 6(*d*), the outer ends of the outer contact pieces 2a2, 2b2 are bent at roughly 90 degrees toward the bases 2a4, 2b4.

The contacts 2a3*p*, 2b3*p* at the free ends of the inner contact pieces 2a3, 2b3 are, as shown in FIG. 2(*a*), FIG. 2(*b*), FIG. 3, and FIG. 8(*b*), disposed so that they come into contact with the bull's eye output terminals of the microphone M. More specifically, the contact 2a3*p* of the inner contact piece 2a3 of the first terminal member 2*a* is positioned to come into contact with the center terminal t1 of the microphone M, and the inner contact piece 2b3 of the second terminal member 2*b* is positioned to come into contact with the outer perimeter terminal t2 of the microphone M. The lower sections of the inner contact pieces 2a3, 2b3 are, as described above, inserted along with the bases 2a4, 2b4 into the lower through-slits 7a3, 7b3 of the first terminal attachment slit and the second terminal attachment slit and are extended into the contact piece space 1*b*. The contacts 2a3*p*, 2b3*p* are inserted into the microphone holding section 1 from the back side by way of the contact piece space 1*b*.

In this state, the contacts 2a3*p*, 2b3*p* are positioned immediately in front of and separated by a slight gap, from the projection 1*c* on the back surface of the contact piece space 1*b*. When the microphone M is mounted in the microphone holding section 1 and the output terminals thereof are pushed back so that the contacts 2a3*p*, 2b3*p* are pushed back, the back sides of the contacts abut the apex of the projection 1*c*, resulting in support being provided from behind.

Also, with the bases 2a4, 2b4 are inserted into the lower through-slits 7a3, 7b3 of the first terminal attachment slit and the second terminal attachment slit, the outer contact pieces 2a2, 2b2 are projected upward from the bases 2a4, 2b4 while projecting out from the main holder unit 3, abutting the contact surfaces 7a2, 7b2. The back outer terminals 2a1, 2b1 at the uppermost positions are inserted and secured in the outer terminal engagement slits 7a1, 7b1.

As FIG. 1(*d*) shows a rearward view of the different elements of the first terminal member 2*a* which are inserted from the left to the corresponding sections of the first terminal attachment slit on the left side. Similarly, the different elements of the second terminal member 2*b* are inserted from the right to the corresponding sections of the second terminal attachment slit on the right side. As a result, the pieces are attached with the various alignments described above.

As can be seen from the above description, the first terminal member 2*a* and the second terminal member 2*b* are formed with structures that have their left and right sides reversed, while the base 2a4 of the former is laterally longer than the latter's base 2b4, and the former's outer contact piece 2a2 is formed wider than the latter's outer contact piece 2b2. Furthermore, the outer contact piece 2a2 of the former is projected upward from an intermediate position on the base 2a4, while the outer contact piece 2b2 of the latter is projected upward from the outermost end of the base 2b4.

As shown in FIG. 7(*a*) through FIG. 7(*d*) and FIG. 8(*a*) through FIG. 8 (*c*), the main socket unit 5 is formed with a box-shaped section forming the holder holding section 4 as its main component. Other similarly box-shaped elements are added to this. The entire structure is formed integrally with a plastic having some degree of elasticity.

As described above, the holder holding section 4 is a holding space that allows the microphone holder to be slid in. As shown in FIG. 7(*a*), FIG. 8(*a*), and FIG. 8 (*b*), the shape of the space allows the microphone holder to be mounted so that the bases 2a4, 2b4 of the first terminal member 2*a* and the second terminal member 2*b* are oriented downward. The microphone holder is formed from the main holder unit 3 and the first terminal member 2*a* and the second terminal member 2*b*, with the outer contact pieces 2a2, 2b2 of the terminal members being in a connected state and exposed from the contact surfaces 7a2, 7b2 at the back lower section of the main holder unit 3. Thus, the shape of this structure is almost completely the same as the shape of the main holder unit 3. As a result, the shape of the holder holding section 4 forms a thick, plate-shaped space that slightly exceeds the thickness and width of the main holder unit 3.

Figure 9A:
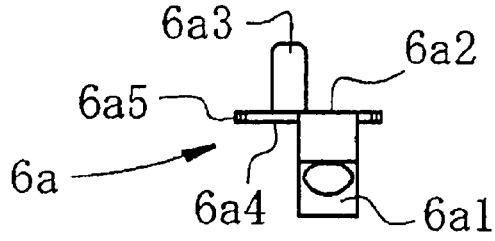
FIG. 9(*a*) is a front-view drawing of a first intermediate terminal member, FIG. 9 (*b*) is a right side view drawing of a first intermediate terminal member, FIG. 9(*c*) is a bottom-view drawing of a first intermediate terminal member.
Figure 9B:
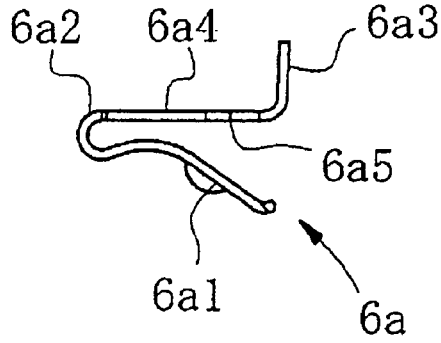
Figure 9C:
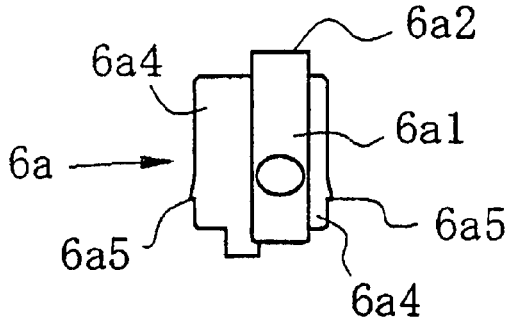
Figure 10A:
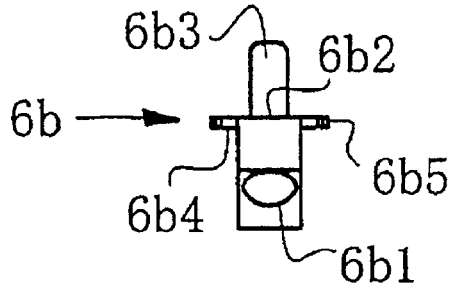
FIG. 10(*a*) is a front side view drawing of a second intermediate terminal member, FIG. 10(*b*) is a right side view drawing of a second intermediate terminal member, FIG. 10 (*c*) is a bottom-view drawing of a second intermediate terminal member.
Figure 10B:
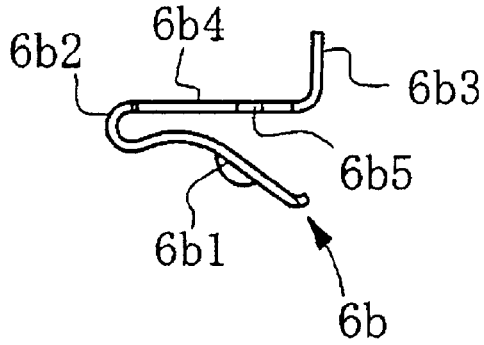
Figure 10C:
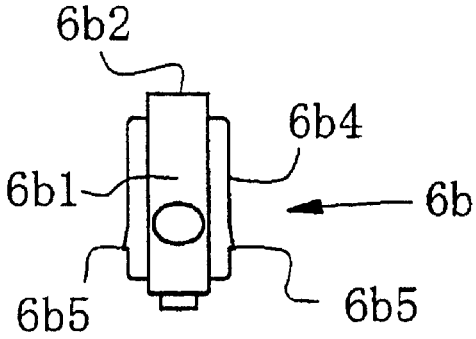

As shown in FIG. 8(*a*) through FIG. 8(*c*), FIG. 9(*a*) through FIG. 9 (*c*), and FIG. 10 (*a*) through FIG. 10(*c*), the first intermediate terminal member 6*a* and the second intermediate terminal member 6*b* are elastic members having almost identical basic structures and are formed as inverted V-shaped structures including inner contact pieces 6a1, 6b1 coming into contact with outer contact pieces 2a2, 2b2 of the first terminal member 2*a* and the second terminal member 2*b*, bends 6a2, 6b2 formed as downward bends of the upper ends of the inner contact pieces; outer contact pieces 6a3, 6b3 formed at the bottom ends of the bends; and extensions 6a4, 6a4, 6b4, 6b4 formed from both sides and extending from an intermediate position of the bends 6a2, 6b2 to the bottom ends. These are composed from conductive metals or materials.

As shown in FIG. 8(*b*), FIG. 9(*a*) through FIG. 9(*c*), and FIG. 10(*a*) through FIG. 10 (*c*), the outer contact pieces 6a3, 6b3 are formed as 90 degree bends at the bottom ends of the bends 6a2, 6b2 in the direction opposite from the inner contact pieces 6a1, 6b1.

As shown in FIG. 9(*a*) through FIG. 9(*c*) and FIG. 10(*a*) through FIG. 10(*c*), the extensions 6a4, 6a4, 6b4, 6b4 are formed by extending to both sides the sections described above of the bends 6a2, 6b2, with engagement offsets 6a5, 6a5, 6b5, 6b5 formed on both sides at intermediate positions on the wide sections. The bottom sections of the engagement offsets 6a5, 6a5, 6b6, 6b5 extend outward at right angles from the sides, and the top sections extend diagonally from the outermost end of the extension to the sides of the extensions 6a4, 6a4, 6b4, 6b4.

As shown in FIG. 7(*a*), FIG. 7(*d*), and FIG. 8(*b*), a first terminal holding section 8*a* and a second terminal holding section 8*b* are formed in the main socket unit 5, and the first intermediate terminal member 6*a* and the second intermediate terminal member 6*b* are disposed in the corresponding spaces. The inner contact pieces 6a1, 6b1 of the first intermediate terminal member 6*a* and the second intermediate contact member 6*b* are abutted against the outer contact piece 2*a* of the first terminal member 2*a* and the outer contact piece 2b2 of the second terminal member 2*b* on the microphone holder side respectively.

As shown in FIG. 7(*a*), FIG. 7(*d*), FIG. 8(*b*), and FIG. 8(*c*), the first terminal holding section 8*a* and the second terminal holding section 8*b* are formed at positions aligned with the outer contact piece 2a2 of the first terminal member 2*a* and the outer contact piece 2b2 of the second terminal member 2*b*, which are exposed at the bottom of the microphone holder held in the holder holding section 4. The holding sections are open to the holder holding section 4 and also form a through-space with a four-sided cross-section shape that opens to the top and bottom.

Engagement grooves 8a1, 8b1 are formed on the first terminal holding section 8*a* and the second terminal holding section 8*b* and are extended from the inwardmost surfaces thereof, i.e., the surfaces facing the microphone holder mounted in the holder holding section 4. As shown in FIG. 8(*c*), these engagement grooves 8a1, 8b1 are formed at positions corresponding to the upper ends to the lowermost ends of the extensions 6*a*4, 6*a*4, 6*b*4, 6*b*4 of the first intermediate terminal member 6*a* and the second terminal member 6*b* mounted in the first terminal holding section 8*a* and the second terminal holding section 8*b*

As shown in FIG. 8(*c*), when the first intermediate terminal member 6*a* and the second intermediate terminal member 6*b* are mounted in the first terminal holding section 8*a* and the second terminal holding section 8*b* respectively, the upper ends of the former's extensions 6*a*4, 6*a*4, 6*b*4, 6*b*4 abut the upper ends of the latter's engagement grooves 8*a*1, 8*b*1, restricting upward movement. Meanwhile downward movement is restricted and the structures are secured by the engagement between the engagement offsets 6*a*5, 6*a*5, 6*b*5, 6*b*5 of the extensions 6*a*4, 6*a*4, 6*b*4, 6*b*4 and the engagement grooves 8*a*1, 8*b*1. As shown in FIG. 8(*b*), the ends of the former's inner contact pieces 6*a*1, 6*b*1 are inserted into the holder holding section 4.

Thus, as described above, with the microphone attachment device according to this embodiment, when the microphone M is mounted into the microphone holding section 1 of the main holder unit 3 from the front, the mounting can be done easily, while the microphone M is prevented from slipping out by the stopper 1*a* formed at the bottom of the opening edge, thus securing the mounted state as indicated by the dotted line in FIG. 2 (*a*).

As shown in FIG. 2(*b*) and FIG. 3, the output terminals of the microphone M are formed in a bull's eye arrangement. Thus, regardless of the circumferential orientation of the microphone M when it is mounted, a reliable connection is formed between the center terminal t1 and the inner contact piece 2*a*3 of the first terminal member 2*a*, and a reliable connection is formed between the outer perimeter terminal t2 and the inner contact piece 2*b*3 of the second terminal member 2*b*. Thus, problems and short-circuits between the two are prevented.

The socket described above is secured at a predetermined position to a circuit substrate not shown in the figures. The securing of the socket is performed by placing the lower section of the main socket unit 5 at the predetermined position and using predetermined securing means. In this state, the output contact pieces 6*a*3, 6*b*3 of the first intermediate terminal member 6*a* and the second intermediate terminal member 6*b* project slightly from the bottom of the first terminal holding section 8*a* and the second terminal holding section 8*b* of the main socket unit 6*a*, and the contact pieces form an elastic connection with corresponding terminals disposed on the circuit substrate. In this manner, the first intermediate terminal member 6*a* and the second intermediate terminal member 6*b* form an electrical connection with the circuit substrate.

Then, as described above, the microphone holder holding the microphone M is mounted in the holder holding section 4 of the socket, as shown in FIG. 7(*a*), and FIG. 8(*a*) through FIG. 8(*c*). This completes the microphone attachment operation.

As described above, the first terminal member 2*a* and the second terminal member 2*b* of the microphone holder form a V shape when seen from the side. When the microphone holder is mounted in the holder holding section 4, the contact surface of the outer contact pieces 2*a*2, 2*b*2 are sloped downward, as shown in FIG. 8(*b*). Also, since the first intermediate terminal member 6*a* and the second intermediate terminal member 6*b* are held in the first terminal holding section 8*a* and the second terminal holding section 8*b* in a roughly inverted V shape, the contact surfaces of the inner contact pieces 6*a*1, 6*b*1 form an upward slope, as shown in the same figure. Thus, when the microphone holder is slid into the holder holding section 4, as described above, the outer contact pieces 2*a*2, 2*b*2 of the first terminal member 2*a* and the second terminal member 2*b* come into contact with the corresponding inner contact pieces 6*a*1, 6*b*1 of the first intermediate terminal member 6*a* and the second intermediate terminal member 6*b*. When the microphone holder is completely mounted in the holder holding section 4, reliable connections can be maintained.

Also, as described above, the bases 2*a*4, 2*b*4 of the first terminal member 2*a* and the second terminal member 2*b* are extended as much as possible to their respective sides. The outer contact pieces 2*a*2, 2*b*2 are projected outward at the predetermined positions described above of the bases 2*a*4, 2*b*4. Also, the outer contact pieces 2*a*2, 2*b*2 are made wide. As a result, short-circuits are prevented while reliable connections are made with the inner contact piece 6*a*1 of the first intermediate terminal member 6*a* and the inner contact piece 6*b*1 of the second intermediate terminal member 6*b* of the socket. Also, as a result, the shape of the structure can be set up with relative freedom to suit the application.

The first terminal member 2*a*, the second terminal member 2*b*, the first intermediate terminal member 6*a*, and the second intermediate terminal member 6*b* are all formed roughly in V shapes or inverted V shapes, and they are all formed with members having elasticity. As a result, the necessary load can be obtained in a small space in the connections for the inner contact pieces 2*a*3, 2*b*3 of the first terminal member 2*a* and the second terminal member 2*b* with the center terminal t1 and the outer perimeter terminal t2 of the microphone M and the outer contact pieces 2*a*2, 2*b*2 of the first terminal member 2*a* and the second terminal member 2*b* with the inner contact pieces 6*a*1, 6*b*1 of the first intermediate terminal member 6*a* and the second intermediate terminal member 6*b*.

Since the main holder unit 3 is also formed with a member having elasticity, the elasticity improves the connections for the center terminal t1 and the outer perimeter terminal t2 of the microphone M with the inner contact pieces 2*a*3, 2*b*3 of the first terminal member 2*a* and the second terminal member 2*b*, and the outer contact pieces 2*a*2, 2*b*2 of the first terminal member 2*a* and the second terminal member 2*b* with the inner contact pieces 6*a*1, 6*b*1 of the first intermediate terminal member 6*a* and the second intermediate terminal member 6*b* of the socket.

As a result, with the microphone attachment device of this embodiment, the output audio signal of a microphone can be reliably transmitted to a circuit substrate.

Also, with the microphone attachment device of this embodiment as described above, the first terminal member 2*a* and the second terminal member 2*b* of the microphone holder are slid from the sides into the first terminal attachment slit and the second terminal attachment slit formed at the rear sides of the main holder unit 3. As a result, the attachment operation is easy. In particular, the back of the main holder unit 3 can be made compact, and the microphone attachment device can be made compact overall. Furthermore, the first intermediate terminal member 6*a* and the second intermediate terminal member 6*b* are disposed in the corresponding first terminal holding section 8*a* and the second terminal holding section 8*b*, which open to the sides of the holder holding section 4. This makes the structure simple and makes the assembly process efficient.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A microphone attachment device comprising:

a microphone holder disposed in a socket having a side;

a microphone disposed in the microphone holder;

said microphone holder including:

a main holder unit equipped with a microphone holding section and a pair of terminal attachment slits; and a first elastic terminal member and a second elastic terminal member inserted into said terminal attachment slits, said first elastic terminal member including:

a first inner contact piece coming into contact with a center terminal of an output terminal of said microphone, a first outer contact piece exposed to said socket side, and a first base connecting said first inner contact piece and said first outer contact piece, said second elastic terminal member including:

a second inner contact piece coming into contact with an outer perimeter terminal of said output terminal of said microphone, a second outer contact piece exposed to said socket side, and a second base connecting said second inner contact piece and said second outer contact piece, said first and second elastic terminal members being formed with a V-shaped bend near said first and second bases;

said socket including:

a main socket unit equipped with a holder holding section into which said microphone holder is inserted; and a pair of elastic intermediate terminal members formed in an inverted V shape including, on a first end, inner contact pieces coming into contact with respective said first and second outer contact pieces of said first and second elastic terminal members of said microphone holder held in said holder holding section of said main socket unit, and, on a second end, said first and second intermediate terminal members outer contact pieces.

2. A microphone attachment device as described in claim 1, wherein said microphone holding section opens to a front surface of said main holder unit.

3. A microphone attachment device as described in claim 1 wherein:

said pair of terminal attachment slits is formed so that said pair of terminal members can be inserted at a rear section of said main holder unit from both sides; and said first and second elastic terminal members are formed to allow insertion into said pair of terminal attachment slits from their respective sides.

4. A microphone attachment device as described in claim 1, wherein each of said pair of terminal attachment slits is formed from outer end engagement slits disposed at an intermediate position on a back surface of said main holder unit to allow insertion of corresponding back outer ends of said outer contact pieces of said first and second elastic terminal members; contact surfaces disposed on a lower section of a back surface of said main holder unit to position said outer contact pieces of said terminal members; and lower through-slits disposed at a lower section of said main holder unit.

5. A microphone attachment device as described in claim 1, wherein said output terminal of said microphone held in said microphone holding section of said main holder unit is formed in a bull's eye arrangement.

6. A microphone attachment device as described in claim 1, wherein:

said inner contact piece are formed so that, when facing a back surface of said main holder unit of said microphone holder, a connection is formed with said outer contact pieces, of said pair of terminal members of said microphone holder held in said holder holding section of said main socket unit;

downward bends are formed at upper ends of said inner contact pieces; and outer contact pieces connect with lower ends of said bends.

7. A microphone attachment device as described in claim 1, wherein:

with said pair of terminal members disposed in terminal attachment slits of said main holder unit, said base of said terminal member extends laterally away from said inner contact piece of said terminal member, said base of said terminal member extends laterally away from said inner contact piece of said terminal member, said outer contact piece is projected upward from a position away from said inner contact piece of said terminal member, and said outer contact piece is projected upward from a position away from said inner contact piece of said terminal member.

8. A microphone attachment device as described in claim 1, wherein:

terminal holding sections opening to said holder holding section are formed at positions on said socket facing said outer contact pieces of said pair of terminal members of said microphone holder mounted in said holder holding section; and said intermediate terminal members are disposed in said terminal holding sections.

9. A microphone attachment device as described in claim 2, wherein:

said pair of terminal attachment slits is formed so that said pair of terminal members can be inserted at a rear section of said main holder unit from both sides; and said first and second elastic terminal members are formed to allow insertion into said pair of terminal attachment slits from their respective sides.

10. A microphone attachment device as described in claim 2, wherein each of said pair of terminal attachment slits is formed from outer end engagement slits disposed at an intermediate position on a back surface of said main holder unit to allow insertion of corresponding back outer ends of said outer contact pieces of said first and second elastic terminal members; contact surfaces disposed on a lower section of a back surface of said main holder unit to position said outer contact pieces of said terminal members; and lower through-slits disposed at a lower section of said main holder unit.

11. A microphone attachment device as described in claim 2, wherein said output terminal of said microphone held in said microphone holding section of said main holder unit is formed in a bull's eye arrangement.

12. A microphone attachment device as described in claim 2, wherein:

said inner contact piece are formed so that, when facing a back surface of said main holder unit of said microphone holder, a connection is formed with said outer contact pieces, of said pair of terminal members of said microphone holder held in said holder holding section of said main socket unit;

downward bends are formed at upper ends of said inner contact pieces; and outer contact pieces connect with lower ends of said bends.

13. A microphone attachment device as described in claim 2, wherein:

with said pair of terminal members disposed in terminal attachment slits of said main holder unit, said base of said terminal member extends laterally away from said inner contact piece of said terminal member, said base of said terminal member extends laterally away from said inner contact piece of said terminal member, said outer contact piece is projected upward from a position away from said inner contact piece of said terminal member, and said outer contact piece is projected upward from a position away from said inner contact piece of said terminal member.

14. A microphone attachment device as described in claim 2, wherein:

terminal holding sections opening to said holder holding section are formed at positions on said socket facing said outer contact pieces of said pair of terminal members of said microphone holder mounted in said holder holding section; and said intermediate terminal members are disposed in said terminal holding sections.

* * * * *